US006206547B1

(12) United States Patent
Erlich

(10) Patent No.: US 6,206,547 B1
(45) Date of Patent: Mar. 27, 2001

(54) LIGHT-EMITTING HANDLE FOR SWIMMING POOL CLEANER

(75) Inventor: Giora Erlich, North Caldwell, NJ (US)

(73) Assignee: Aqua Products Inc., Cedar Grove, NJ (US)

( * ) Notice: Subject to any disclaimer, the term of this patent is extended or adjusted under 35 U.S.C. 154(b) by 0 days.

(21) Appl. No.: 09/179,567

(22) Filed: Oct. 27, 1998

(51) Int. Cl.[7] ..... F21V 4/00

(52) U.S. Cl. ..... 362/276; 362/89; 362/91; 362/158; 362/223; 362/399; 362/109; 15/1.7; 15/324

(58) Field of Search ..... 362/276, 120, 362/253, 109, 89, 91, 158, 267, 399, 400, 225, 223, 390, 369; 15/1.7, 324

(56) References Cited

U.S. PATENT DOCUMENTS

| | | | | |
|---|---|---|---|---|
| 2,640,146 | * | 5/1953 | Smith | 240/51.11 |
| 5,197,797 | * | 3/1993 | Jaksich | 362/219 |
| 5,351,355 | * | 10/1994 | Chiniara | 15/1.7 |
| 5,450,299 | * | 9/1995 | Lepre | 62/146 |
| 5,775,797 | * | 7/1998 | Henstra | 362/225 |

* cited by examiner

*Primary Examiner*—Sandra O'Shea
*Assistant Examiner*—Ben Fraud Zeade
(74) *Attorney, Agent, or Firm*—Abelman, Frayne & Schwab

(57) ABSTRACT

An automatic swimming pool cleaner is equipped with an electrically-powered light source that is securely mounted on, or above the exterior of the housing of the pool cleaner so that the light source illuminates a generally spherical space above and 360° around the pool cleaner. The light source is contained in a transparent hollow receptacle fabricated from an impact-resistant, rigid, light transmitting material. In a pool cleaner with a detachable handle, the handle's horizonal gripping member is constructed from a transparent annular tube in which the light source is axially mounted, the ends of the tube being provided with a waterproof seal where they are joined to the handle brackets. The light source can be one or more lamps or bulbs, preferably of a tubular configuration, such as an array of fluorescent tubes of the folded type that have a socket at one end, the free end being held by a resilient supporting member. The conductor from the lamp socket, and any associated IC devices, pass through the waterproof seal and to the interior of the pool cleaner's housing where it is connected to a source of power.

33 Claims, 2 Drawing Sheets

FIG. 2
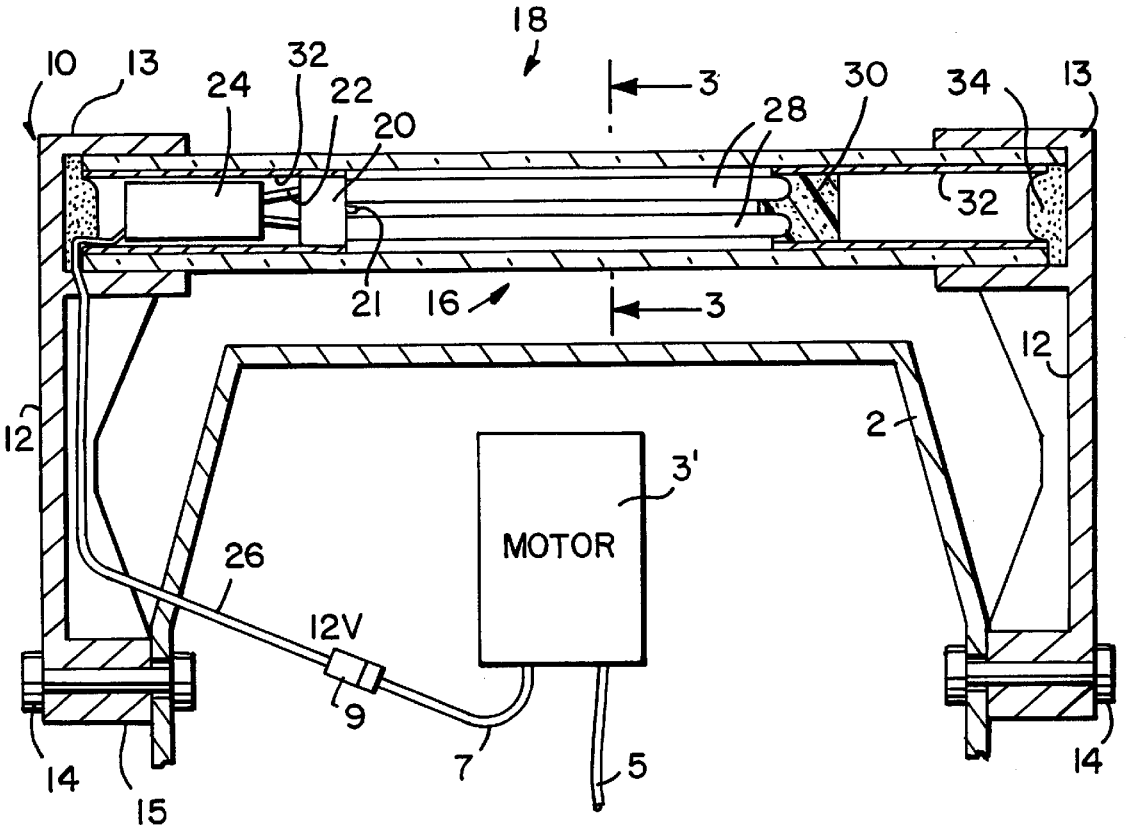
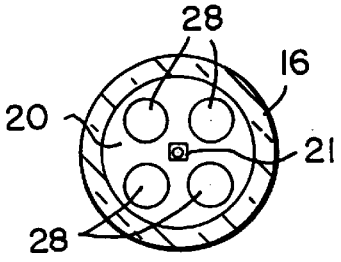
FIG. 3

LIGHT-EMITTING HANDLE FOR SWIMMING POOL CLEANER

FIELD OF INVENTION

The invention relates to a light source for submersible swimming pool cleaners.

BACKGROUND

Swimming pool cleaners equipped with an electric power supply for operating the drive motor and/or pump(s) have been used to clean pools for decades. However, it has not been the practice to equip such pool cleaners with a light source to illuminate the surface being cleaned or areas remote from the moving cleaner. It would be desirable to provide a source of light that illuminates the whole pool and to provide illumination visible from areas such as the pool deck or patio adjacent the pool.

It is therefore a principal object of the invention to provide an automatic pool cleaner with a light source that will illuminate the pool.

It is also an object of the invention to provide a light-emitting handle for a pool cleaner that provides a high-level of illumination by employing one or more electric light sources that are located above the top of the cleaner's housing and can transmit light in a 360° pattern about the axis of the handle.

A further object of the invention is to provide light source on an automatic pool cleaner as a safety feature that will alert potential bathers that the electrically-powered appliance is operating in the pool.

Another object of the invention to provide an electrically powered light-emitting handle that is shock and impact resistant and safe to operate in a pool that may be occupied by swimmers and bathers.

Yet another object of this invention is to provide a light-emitting handle as either original equipment or as a replacement part, that is of rugged construction and that can be economically manufactured for use on a variety of different models of powered pool cleaners.

It is also an object of the invention to provide a method of providing a moving source of submerged light for illuminating the interior of a swimming pool during hours of darkness.

A further object of the invention is to provide a light-emitting element that comprises a replacement part for existing handle assemblies of the type that are attached to the opposite sides of the pool cleaner housing of pool cleaners that are presently being used in the art.

Yet another object of this invention is to provide a source of illumination that can be removed from, and activated independently of the pool cleaning apparatus to illuminate the submerged area of a pool.

SUMMARY OF INVENTION

As most broadly contemplated, the above objects and additional advantages are realized by the invention which comprises an electrically-powered light source that is securely mounted on, or above the exterior of the housing of a swimming pool cleaner so that the light source illuminates a generally spherical space above and 360° around the pool cleaner. The light source is contained in a transparent hollow receptacle fabricated from an impact-resistant, rigid, light transmitting material. The hollow receptacle has at least one opening providing access to it interior. The electrically-powered light source, comprised of one or more lamps, is secured in the interior of the receptacle and appropriate conductors, e.g. wires, are attached to the light source, as through a socket and/or any other necessary electronic circuitry or devices required to provide the requisite power to the lamps. The free ends of the conductors extend outside of the receptacle. The receptacle is then sealed to make it water-tight, the conductor extending through the seal. The receptacle containing the light source is then secured to the pool cleaner housing and the free ends of the conductors are connected, e.g., via a quick-release plug located on the interior of the housing to a source of power, so that when the pool cleaner is activated, the light source is illuminated.

In an especially preferred embodiment of the invention, a handle for a pool cleaner is provided in which the handle's horizonal griping member comprises a transparent or translucent annular tube in which is axially mounted an electrically-powered light source, the ends of the tube being provided with a waterproof seal where they are joined to the handle brackets. In a preferred embodiment, the tube is transparent and is fabricated from a polymer that has high impact resistance and that is also resistant to UV discoloration and to the degradation by water treatment chemicals customarily employed in swimming pools.

The light source can be one or more lamps or bulbs, preferably of a tubular configuration, since that shape will provide the maximum illumination along the length of the tube of the handle, and also will permit a plurality of light sources to be assembled in a generally parallel array along the interior of the tube. In a further preferred embodiment, the light source is comprised of an array of fluorescent tubes of the folded type that have a socket at one end, the opposite ends being free. The free ends are supported by a resilient or other shock-absorbing material that is secured in the interior of the transparent tube.

The power supply for the light source is conveniently obtained by tapping a separate conductive feed from a pump or motor on the interior of the pool cleaner's housing, and passing the conductor through the housing and the handle's mounting bracket to the interior of the tube where it is connected directly to the lamp socket, or optionally, through a transformer or other electronic voltage control device. In the embodiment employing fluorescent tubes, the low voltage (usually 12 volts) used to power the motor and/or pump(s) will have to be increased to power the fluorescent lights. The electrical conductors or wires can be conveniently sealed in place with a pliable waterproof epoxy or other self-hardening polymeric compound that is pressed into the open ends of the tube to provide the waterproof seal. Alternatively, molded plastic or synthetic rubber seals can be fitted into one or both ends of the transparent tube, and either sealed permanently in place, or made removable so that the components on the interior of the tube can be accessed for servicing.

In a further preferred embodiment of the invention, the sections of the transparent tube that are not immediately adjacent to the light source are lined, coated, covered, or otherwise masked with an opaque material so that the various elements in the interior of the transparent tube, other than the light source, are not readily visible through the transparent tube.

BRIEF DESCRIPTION OF THE DRAWINGS

The invention will be described with reference to the attached drawings in which

FIG. 2 is a cross-sectional view taken along the principal axis of the handle assembly; and FIG. 3 is a cross-sectional view taken along section line 3—3 of FIG. 2.

DETAILED DESCRIPTION OF THE PREFERRED EMBODIMENT

Figure 1:
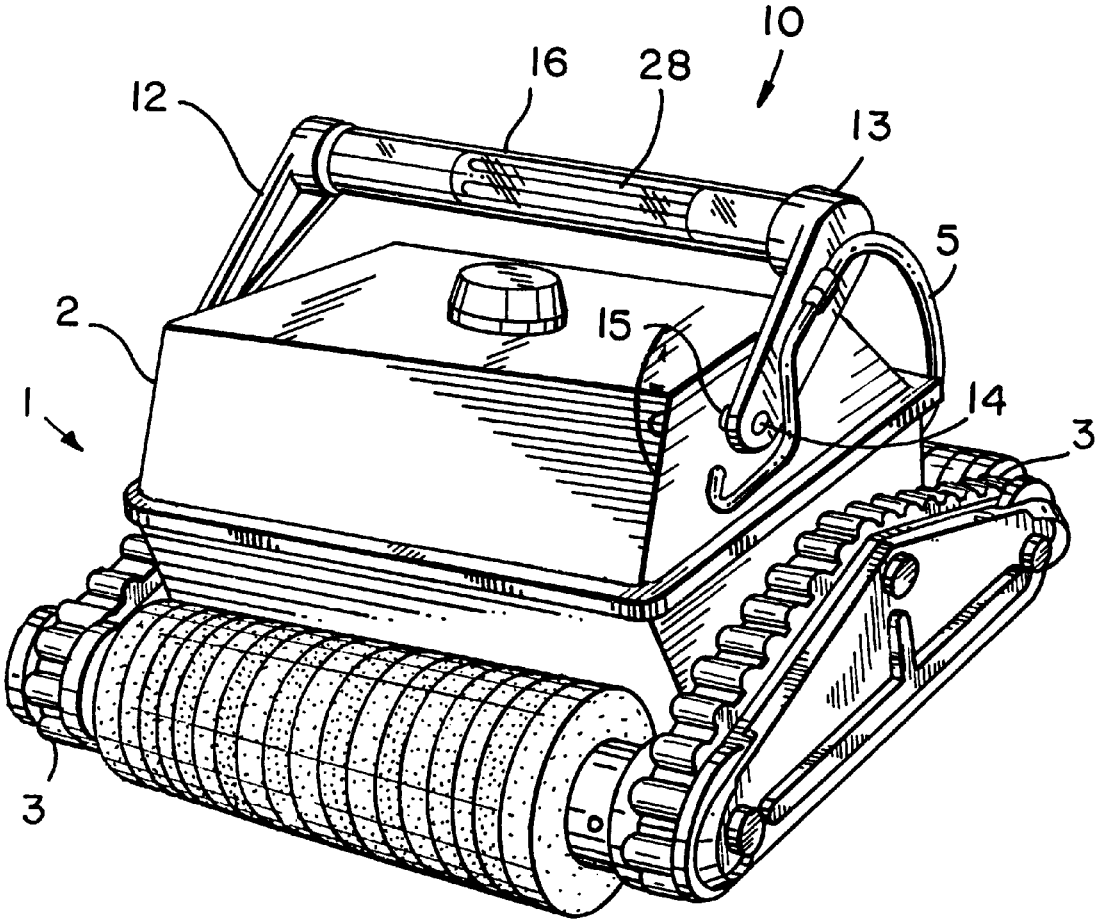
FIG. 1 is a top perspective view of a pool cleaner fitted with the light emitting handle of the invention.

With reference to FIG. 1 there is shown an electrically-powered pool cleaner 1 having a housing 2 and drive means 3 of conventional design that is equipped with handle assembly 10 of the invention. Handle assembly 10 is comprised of a pair of elongated handle brackets 12, one end of each being movably attached to the pool cleaner housing 2, the free ends 13 of the brackets being secured to the handle's transparent gripping member 16. As shown in FIG. 2, attachment pin 14 passes through a boss 15 in order to secure one end of handle bracket 12 to pool cleaner housing 2.

With reference to the cross sectional view of FIG. 2, it can be seen that transparent tube 16 can be of any cross sectional configuration, including circular, square or polygonal. The surface of the transparent tube 16 can also be provided with longitudinal flutes, spiral grooves or any other contoured configuration required to achieve a desired aesthetic effect. In a preferred embodiment, the transparent tube is annular and of circular cross section, which can be formed by extrusion and is a common item of commerce. A tube of circular cross section also has the advantage of mating with elongated handle brackets of existing pool cleaner design.

In the embodiment of FIG. 2, the light source shown comprises a plurality of fluorescent tubes of the folded type, the ends of which are mounted in a socket which is secured to the interior surface of transparent tube 16. The free ends of the fluorescent tubes are supported by a resilient, shock absorbing support member 30 which is also secured to the interior of tube 16. Support 30 can be fabricated, as by molding or machining a foamed polymer, such as PVC or expanded polystyrene.

The electrical power for the light source is provided by power cord 26 which extends from the interior of the housing 2 through an orifice in the bracket 12 and into the interior of tube 16. Since the power supply of a pool cleaner is of relatively low voltage, e.g., 12 volts, a transformer 24 or other voltage regulating means incorporated into an integrated circuit device is employed to raise the voltage to the required level. Electrical conductors 22 connect voltage control device 24 to socket 20. With further reference to FIG. 2, the lamp power cord 26 is shown terminating in a quick disconnect plug 9 that is also attached to power take-off cord 7 attached to motor 3'. External power cord 5 supplies power to the motor from a remote 12-volt power supply (not shown) outside of the pool.

In order to insure the safe operation of the light emitting handle during submerged operation, the ends of transparent tube 10 are preferably permanently sealed with an initially pliable epoxy resin or a solvent type cement that hardens to form a permanent waterproof seal 34. As can be seen with reference to FIG. 2, power cord 26 is sealed in place and passes through the epoxy resin 34 at the end of the tube. In order to further enhance the operational safety of the light emitting handle, the free ends of the handle brackets 12 are formed with sockets 13 that securely receive the end of tube 16 in a close-fitting relation. The handle brackets are advantageously fitted to the free ends of the tube after the pliable epoxy resin seal has been put in place so that when the epoxy resin hardens it forms a bond with the surrounding handle bracket, thereby forming a unitary assembly. In the event of a failure of one or more of the light sources or other components on the interior of the tube, the entire handle assembly is replaced, thereby assuring that all original safety standards are met and the and the risks associated with improper or casual repairs are avoided.

In an alternative embodiment, epoxy resin seal 34 is replaced at one or both ends with a removable sealing member (not shown), that can be, for example, molded from a resilient or rigid polymer, and fit in place as a cap or plug for the tube. A removable seal would permits the components inside of the tube to be serviced in the event of a failure, e.g., the replacement of a lamp.

In a further preferred embodiment, the ends of the tube that are longitudinally displaced from the central section containing the light source are masked, as by inserting a close-fitting cylinder of opaque material 32 that extends, respectively, from the open end of the tube to the face of the supporting member 30 at one end, and to the interior face of the socket 20 at the other end of tube 12. The purpose of mask 32 is aesthetic, as it conceals all of the elements on the interior of the tube, save for the light source. In this way, the transparent tube appears to provide a source of light suspended in the center of the transparent tube, emitting light rays 360° axially and providing a spherical zone of illumination. The mask 32 can be cut from a flexible web or from an annular cylinder of opaque plastic material, in a color that is chosen to contrast aesthetically with the color scheme of the handle brackets and/or other parts of the pool cleaner.

As shown in the cross sectional view of FIG. 3, a light sensitive, or photo-voltaic switch 21 is also provided on the interior of tube 16. Switch 21 is optionally set to interrupt the flow of power to the light source during daylight hours when the light emitted from the lamps would not be visible. The sensitivity of the switch can be predetermined or made adjustable within a range so that the handle's light source is activated at whatever level of light is desired. When the power to the light service is interrupted, the photo-electric switch is reset.

A further aesthetic effect is created by providing one or more transparent colored auxiliary tubular members that can be placed in close-fitting relation about the exterior surface of the tube to thereby change the color of the transmitted light. This colored auxiliary tubular member is preferably a thin-walled plastic that is longitudinally split to pass over the tube containing the light source. Thus, the color of the light can be modified and attenuated by use of one or more of these colored filters.

As will be understood and appreciated by one familiar with the operation of an automatic pool cleaner, the machine not only traverses the bottom of the pool in an ever-changing pattern, it also climbs the sides of the pool and can move horizontally at the water line. The aesthetic effect created by the light emitting handle of the invention while the pool cleaner is operating at dusk or during the dark hours of the night will be eye-catching and aesthetically interesting to pool-side observers. The pool cleaner equipped with the light emitting handle of the invention provides a very important safety feature during hours of darkness by alerting potential users of the pool that an electrical appliance is operating, when it might not otherwise be apparent. The invention will also serve the very practical and functional purpose of calling the pool owner's attention to the situation should the pool cleaner become immobilized, e.g., as by a ladder or twisted power cord, so that the owner can take appropriate steps to return the cleaner to its normal operating pattern. Since most homeowners clean the pool at night, and the machine runs unattended, this is an important feature for assuring the efficient cleaning of the pool.

It should also be understood that the light-emitting handle assembly can be detached from the pool cleaning apparatus and the lamp power cord attached to a low voltage electric source for submerged use in the pool to provide a novel source of ambient light in the pool. The handle assembly can be produced with neutral buoyancy, and additional weight or flotation added, as by attaching such elements to the bosses 15 at the ends of handle brackets 12. In this mode of operation, the handle assembly can be made to float on the surface, or to settle to the bottom of the pool.

I claim:

1. A light emitting handle assembly for an electrically powered pool cleaner, the pool cleaner having a housing to which the handle assembly is joined and a source of electrical power inside the housing, the handle assembly comprising:

a. a transparent annular tube;

b. a light source fixedly positioned in the interior of the transparent tube;

c. means for electrically powering the light source extending between and connected to the light source and the source of electrical power inside the housing;

d. a waterproof seal at each end of the transparent tube, whereby fluid is prevented from contacting the light source when the pool cleaner handle assembly is submerged; and e. an elongated handle bracket mounted on and secured to each end of the transparent tube, each of said handle brackets having means for attachment to the housing.

2. The handle assembly of claim 1 where the light source comprises a plurality of fluorescent tubes.

3. The handle assembly of claim 2 which further comprises at least one socket for receiving the fluorescent tubes and voltage regulating means electrically connected to the socket.

4. The handle assembly of claim 1 in which the sections of the tube longitudinally adjacent to the light source are masked, whereby the exterior of the tube is concealed.

5. The handle assembly of claim 4 in which the interior of the tube is masked by an opaque annular member lying adjacent to the interior surface of the transparent tube.

6. The handle assembly of claim 1 where the waterproof seal comprises an epoxy resin.

7. The handle assembly of claim 6 where the handle brackets are secured to the respective ends of the tube by the epoxy resin.

8. The handle assembly of claim 3 in which one socket receives the fluorescent tubes and which further comprises a resilient member securely positioned in the interior of the transparent tube and in supporting contract with the free ends of the fluorescent tubes.

9. The handle assembly of claim 1 where the transparent tube is fabricated from polymeric composition selected from the group consisting of polyvinyl chloride polymers, acrylic polymers, styrene polymers, acrylonitrile-butadiene-styrene polymers, and co-polymers and blends of said polymers.

10. The handle assembly of claim 1 in which the means for electrically powering the light source is a pair of flexible wire conductors that pass through the waterproof seal at one end of the transparent tube, and through orifices in the handle bracket and the pool cleaner housing, said conductors terminating in a quick disconnect plug secured to a power take-off cord on the interior of the housing.

11. The handle of claim 1 which is fabricated as an integral disposable assembly.

12. The handle of claim 1 in which the means for sealing one or both ends of the tube are removable, whereby the elongated light source can be removed for maintenance and/or replacement.

13. The handle of claim 1 in which the walls of the transparent tube are contoured.

14. The handle of claim 1 which further comprises a close fitting cylindrical member of transparent colored material on the exterior surface of the transparent tube.

15. The apparatus of claim 1 in which the handle is detachable from the pool cleaning unit.

16. The handle of claim 1 in which the electrical conductors extend to a power source independent of the pool cleaning apparatus.

17. The handle of claim 1 which has neutral buoyancy in the pool water in which it is to be used.

18. An electrically-powered pool cleaner that includes a housing, an electrical power cord one end of which cord terminates in the interior of the housing and a light emitting handle assembly, said light emitting handle assembly comprising:

a. a transparent plastic tube of generally circular cross-section;

b. a plurality of light emitting lamps centrally positioned in the interior of the transparent tube;

c. a least one socket securely mounted in the interior of the tube for receiving the bases of the plurality of lamps;

d. a resilient, shock-absorbing supporting member securely mounted in the interior of the tube in touching alignment with the free ends of the plurality of lamps;

e. an electrical conductor extending from the at least one socket to the terminal end of the power cord in the interior of the housing;

f. waterproof seals at the ends of the transparent tube; and g. a pair of elongated handle brackets extending from the cleaner housing, each handle bracket having a free end for receiving one end of the transparent tube in a secure, close-fitting relation.

19. The pool cleaner of claim 18, where the plurality of light-emitting lamps are a four-tube folded fluorescent lamp fixture.

20. The pool cleaner of claim 19 which further comprises an integrated circuit device for increasing the voltage of the power supplied to the fluorescent lamp fixture.

21. The pool cleaner of claim 18 where the waterproof seals are formed of epoxy resin.

22. The pool cleaner of claim 21 where the epoxy resin waterproof seal is in adhesive contact with the free end of the handle bracket.

23. The pool cleaner of claim 21 which further comprises first and second opaque cylindrical members that are closely fitted against the interior surface of the transparent tube, the first opaque member extending from the face of the supporting member contacting the lamps to the waterproof seal at the adjacent end of the transparent tube, and the second opaque member extending from the socket ends of the lamps to the waterproof seal at the adjacent end of the transparent tube, whereby the opaque members mask the ends of the transparent tube longitudinally adjacent the central section of the tube containing the lamps.

24. The pool cleaner of claim 18 in which the transparent tube is fabricated from impact resistant acrylic polymer.

25. The pool cleaner of claim 18 in which the transparent tube is colored.

26. The pool cleaner of claim 18 which further comprises a light sensing switch, whereby the power to the lamps is interrupted during daylight.

27. A light-emitting tube assembly for use in the handle of an electrically powered pool cleaner, said tube assembly comprising:

a. a transparent impact resistant plastic tube of generally circular cross-section as part of the handle of the pool cleaner;

b. a plurality of light emitting lamps centrally positioned in the interior of the transparent tube;

c. a least one socket securely mounted in the interior of the tube for receiving the bases of the plurality of lamps;

d. a resilient, shock-absorbing supporting member securely mounted in the interior of the tube in touching alignment with the free ends of the plurality of lamps;

e. an electrical conductor extending from the at least one socket through the adjacent end of the tube and terminating in a plug at a distance displaced from the end of the transparent tube; and f. waterproof seals at the ends of the transparent tube.

28. A method for lighting a swimming pool with a submersible, moving light source, said method comprising:

a. providing a transparent hollow receptacle fabricated from an impact-resistant, rigid, light transmitting material said hollow receptacle having at least one opening providing access to its interior;

b. placing an electrically-powered light source in the hollow receptacle;

c. extending electrical conductors from the light source to terminate at a location remote from the hollow receptacle;

d. sealing the at least one opening of the hollow receptacle to make it water-tight;

e. providing an electrically-powered pool cleaner and attaching the sealed hollow receptacle containing the light source to the exterior of the pool cleaner;

f. attaching the conductors to a source of power on the interior of the pool cleaner;

g. providing electrical power via said conductors to activate the light source; and h. operating the pool cleaner to clean the submerged surfaces of the pool.

29. The method of claim 28 where the transparent hollow receptacle is an elongated annular tube.

30. The method of claim 28 where the ends of the elongated annualr tube are attached to elongated handle brackets and the handle brackets are attached to the pool cleaner.

31. An electrically-powered pool cleaning apparatus that includes a housing, an electrical power cord one end of which cord terminates in the interior of the housing and a light emitting assembly, said light emitting assembly comprising:

a. a transparent hollow receptacle having at least one opening providing access to its interior;

b. at least one light emitting lamp positioned in the interior of the transparent hollow receptacle;

c. a least one socket securely mounted in the interior of the hollow receptacle for receiving at least one lamp;

d. an electrical conductor extending from the at least one socket to the terminal end of the power cord in the interior of the housing;

e. a waterproof seal for each of the at least one openings of the transparent hollow receptacle; and f. attachment means for securing the sealed hollow receptacle containing the at least one lamp to the exterior of the pool cleaner housing.

32. The apparatus of claim 31 in which the hollow receptacle is a plastic tube of generally circular cross-section.

33. The apparatus of claim 32 where the at least one light emitting lamp comprises a plurality of fluorescent tubes.

* * * * *